US005758913A

United States Patent [19]

Roth et al.

[11] Patent Number: 5,758,913

[45] Date of Patent: Jun. 2, 1998

[54] IMPACT RESISTANT ELECTROMAGNETIC LOCK

[75] Inventors: Thomas E. Roth, Reno; Dennis E. Wojdan, Sparks, both of Nev.

[73] Assignee: Securitron Magnalock Corp., Sparks, Nev.

[21] Appl. No.: 603,649

[22] Filed: Feb. 20, 1996

[51] Int. Cl.[6] ..... E05C 19/16

[52] U.S. Cl. ..... 292/251.5

[58] Field of Search ..... 292/251.5, DIG. 61, 292/144, 177

[56] References Cited

U.S. PATENT DOCUMENTS

| | | | |
|---|---|---|---|
| 2,530,628 | 11/1950 | Pivero | 292/144 |
| 2,693,382 | 11/1954 | Teetor | 292/251.5 |
| 2,727,772 | 12/1955 | Hamilton | 292/144 |
| 2,877,041 | 3/1959 | Foley | 292/251.5 |
| 3,060,786 | 10/1962 | Flower | 292/251.5 |
| 3,258,285 | 6/1966 | Smith | 292/251.5 |
| 3,576,119 | 4/1971 | Harris | 292/144 |
| 3,843,174 | 10/1974 | Bogunovich et al. | 292/144 |
| 4,022,509 | 5/1977 | Bopp et al. | 292/144 |
| 4,682,801 | 7/1987 | Cook et al. . | |
| 4,720,128 | 1/1988 | Logan, Jr. et al. | 292/251.5 |
| 4,915,431 | 4/1990 | Bailey | 292/251.5 |
| 5,065,136 | 11/1991 | Frolov et al. . | |
| 5,139,293 | 8/1992 | Zimmerman et al. | 292/251.5 |
| 5,380,053 | 1/1995 | Saino | 292/177 |

FOREIGN PATENT DOCUMENTS

| | | | |
|---|---|---|---|
| 424974 | 3/1911 | France | 292/144 |
| 1180547 | 12/1958 | France . | |
| 2621349 | 4/1989 | France | 292/144 |
| 2438312 | 2/1976 | Germany . | |
| 387575 | 3/1977 | Japan | 292/251.5 |
| 648709 | 2/1979 | U.S.S.R. | 292/144 |

*Primary Examiner*—Rodney M. Lindsey
*Attorney, Agent, or Firm*—Oppenheimer Wolff & Donnelly LLP

[57] ABSTRACT

An impact resistant electromagnetic lock includes an electromagnet mounted on a door frame, a ferromagnetic strike plate, and an impact-absorbing assembly for mounting the strike plate to the door. The impact-absorbing assembly fits largely within the door, and includes both a plunger coupled to the strike plate and a spring. When an inertial force directed to forcing the door open such as a kick is directed against the door, the plunger compresses the spring. The resilience provided by the spring allows the door a limited amount of inertia-absorbing linear movement, thus greatly decreasing the maximum force experienced by the door and correspondingly increasing the ability of the door to withstand the inertial attack.

16 Claims, 4 Drawing Sheets

IMPACT RESISTANT ELECTROMAGNETIC LOCK

BACKGROUND OF THE INVENTION

1. Field of the Invention

The present invention relates to the field of impact resistant locks. More particularly, the present invention relates to the field of impact resistant electromagnetic door locks.

2. Description of the Related Art

Electromagnetic door locks are widely used in diverse electronic door applications. These locks typically use electromagnets attached to the door frame in conjunction with a ferromagnetic strike plate attached to the door, to hold the door firmly closed. U.S. Pat. No. 4,682,801 issued to Cook et al. shows one such electromagnetic door lock. Magnetic locks are available in different holding forces with typical strengths ranging from 500 to 2,000 pounds. The strength of an electromagnetic lock is typically measured by pulling it apart with a suitable hydraulic press or some similar instrument. In some installations, the strength of the magnetic lock is important to preserve security against an attempt to physically overcome the magnetic lock and break through the door. A good example of an application where this is a substantial risk is use in prisons.

When one considers the threat to a magnetically locked door from physical attack, one must first note whether the door swings into or away from the side of the door from which an attack can be anticipated. Security is improved if the door swings toward the person attempting to defeat the magnetic lock, because generating a pulling force sufficient to defeat a powerful magnetic lock using only human strength is difficult. However, in many installations, the door swings away from the side from which an attack will come and it is much easier to generate a strong force on the magnetic lock by a person throwing himself at the door or kicking it. Doors oriented this way are commonly found in prisons, where the authorities are attempting to lock people in rather than attempting to keep outsiders from entering the building.

In installations such as prisons where it is anticipated that a large degree of force may be brought to bear against the door, the door itself must be strong, and powerful and expensive magnetic locks have been required. In many cases more than one lock has been mounted on a single door. Generally speaking, the greater the holding force required of the lock, the larger and more expensive the lock must be, and the more electric current it will draw in its locked state. U.S. Pat. No. 5,065,136, issued to Frolov et al., disclose a magnetic lock with a pivoting magnet. This pivoting action is for the purpose of actuating a delay switch, and may incidentally provide a very slight movement of the door, and hence very slight resistance of the door to attack.

SUMMARY OF THE INVENTION

To improve the ability of a door equipped with a magnetic lock to withstand physical attack, and to decrease the costs and other drawbacks associated with high strength magnetic locks, the present invention provides a simple and inexpensive mechanism which greatly improves the resistance of any magnetic lock to this type of attack against the door. The present invention accomplishes this by adding a resilient member or shock-absorbing arrangement to the strike plate mounted on a door within an an otherwise largely rigid door and electromagnetic lock system. The resilient member allows the door to "give" in response to a blow applied to the door, then spring back into its original position. Effectively, the present invention provides the door with linear elasticity in the direction of attack. This linear elasticity allows the door to absorb the kinetic energy of a blow over a much greater distance than would be absorbed by a rigid door having no linear elasticity or capable of only slight linear movement, thus greatly lowering the peak force experienced by the door during a physical attack against the door.

The present invention is useful for protecting a door equipped with an electromagnetic lock against any type of inertial attack. Broadly speaking, an inertial attack is any type of attack in which force is brought to bear against the door at least in part by the deceleration of a moving object. Such inertial attacks include kicking, throwing of objects including oneself against the door, striking the door with a heavy object, and using a battering ram.

In one aspect, the present invention includes an electromagnet for mounting on a door frame, a strike plate for engagement with said electromagnet to provide a predetermined holding force, hardware for mounting said electromagnet on the door frame, hardware for mounting said strike plate on a door for locking engagement with said electromagnet to hold said door in a locked and closed position, and a resilient element included in the strike plate mount, for permitting limited movement of the door and prompt restoration of the door to its locked and closed position.

In a preferred embodiment, a shock-absorbing assembly mounted inside the door includes a spring such that as force is applied that would tend to pull the strike plate away from the door, the spring within the door compresses to allow linear movement of the strike plate relative to the door. When the force is withdrawn, the spring and strike plate rebound back to their original positions. The deflection may be from about one-eighth of an inch (3 mm) to about one-half of an inch (13 mm) to about three-quarters of an inch (19 mm) in response to a severe shock causing full compression of the spring.

In accordance with a preferred illustrative embodiment of the present invention, a bolt housing mounted to the door has an internal cavity which houses a plunger and a spring. The plunger and spring are retained within the bolt housing by a seal cap which threadingly engages the bolt housing. The bolt housing has a flange which abuts one side of the door. A post-installation cap threadingly engages the seal cap and abuts the obverse side of the door, thus holding the bolt housing along with the spring and plunger firmly within the door. The seal cap and post-installation cap have holes through their centers. A strike plate mounting bolt passes through the strike plate as well as through the center holes in the seal cap and the post installation cap, and threadingly engages the plunger. In this way, the strike plate is coupled to the plunger, with the plunger acting against the spring held within the door, whereby a force such as a kick applied to the door causes the plunger to compress down on the spring.

A significant advantage provided by the present invention over prior art doors with pivoting magnets lies in the much greater shock absorbing effect owing to the much greater linear elasticity provided by mounting shock absorbers within the door. It is also simpler to provide one component which mounts in the door and produces the desired movement against a spring rather than completely redesigning the electromagnet component of the system. It is also less expensive to retrofit an existing installation using the present invention, because retrofit in most cases requires merely removing the strike plate and old mounting assembly, enlarging the mounting assembly hole in the door, and installing the strike plate using the inexpensive shock-absorbing mounting assembly of the present invention.

DETAILED DESCRIPTION OF THE PREFERRED EMBODIMENT

Figure 1:
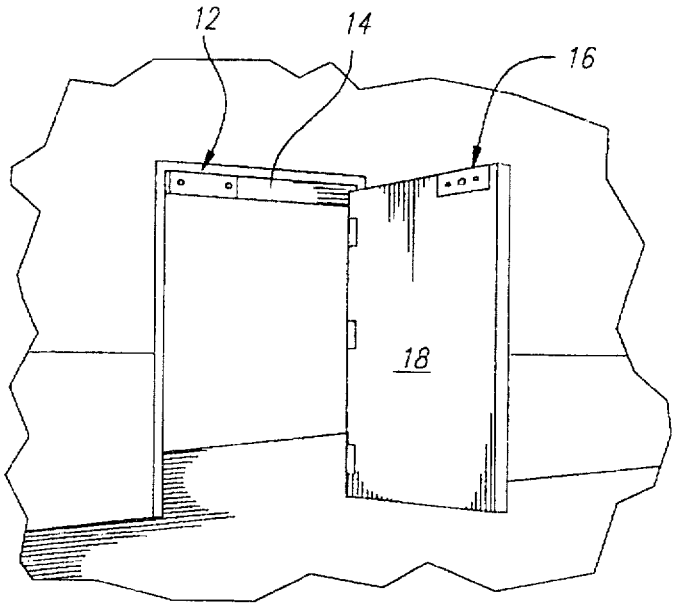
FIG. 1 shows a typical electromagnetic door lock installation.

FIG. 1 shows a typical electronic door lock installation. An electromagnet 12 is built into or secured to a door header 14. A ferromagnetic strike plate 16 is mounted on door 18. When door 18 is closed and electromagnet 12 is energized, electromagnet 12 exerts a magnetic force against strike plate 16 to hold door 18 in a closed and magnetically locked position.

Figure 2:
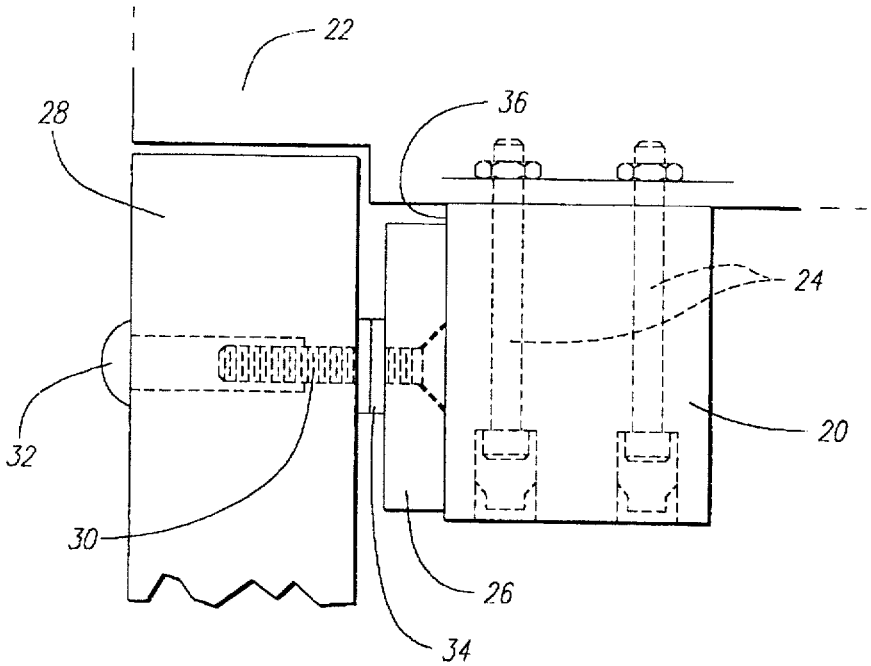
FIG. 2 PRIOR ART
FIG. 2 is a prior art electromagnetic door lock.

FIG. 2 depicts the construction details of a typical electronic door lock of the prior art. An electromagnet 20 is mounted to the header 22 of a door frame by a plurality of tamper resistant mounting bolts 24. Strike plate 26 is mounted to door 28 via strike plate mounting bolt 30. Although strike mounting bolt 30 could thread directly into door 28, the strength of the mounting is increased by use of internally threaded bolt 32 into which strike plate mounting bolt 30 threads. A bolt such as internally threaded bolt 32 that is designed to be tamper resistant from one side is sometimes referred to as a sex bolt. Strike plate mounting bolt 30 also passes through one or more flexible washers 34, which separate strike plate 26 from door 28. Flexible washers 34 allow strike plate 26 to swivel and line up accurately in coplanar abutment with face 36 of electromagnet 20. This is desirable to ensure full planar contact between strike plate 26 and face 36 of electromagnet 20, resulting in maximum hold strength.

In a conventional arrangement such as that shown in FIG. 2, strike plate 26 is more or less rigidly held to door 28 by strike plate mounting bolt 30. Door 28 will experience an inertial force when subjected to an inertial attack such as a kick or an object thrown against the door. The inertial force will be equal to F=ma, where "m" is the mass of the object and "a" is the instantaneous deceleration caused by colliding with door 28. If the peak force experienced by the door is great enough to overcome the electromagnetic holding force, strike plate 26 will separate from face 36 of electromagnet 20, and door 28 will have been forced open.

The more rigid that door 28 is, the more rapid will be the deceleration of the inertial object and hence the greater the force applied to the door. Although the force produced by an inertial object can be lessened by making door 28 somewhat flexible, there are several disadvantages to making door 28 flexible. If the electromagnet is mounted at the top of the door as in FIG. 2, then an attack against the bottom of the door may allow the bottom of the door to bend out far enough so that a crowbar or other object can be inserted between the door and the back side of the door frame. The crowbar could then be used to pry the door open via the increased leveraged gained thereby. The flexibility of the door would also have to be matched to the hold strength of the electromagnetic lock. A flexible door would also give little protection to an inertial attack directed at the top of the door adjacent the strike plate. Additionally, a flexible door is generally structurally weaker than a rigid one such that the flexible door itself can be directly destroyed by an attack regardless of the lock strength. Accordingly, most doors used in locations such as prisons that require moderate to high security employ rigid doors preferably made of steel.

Figure 3:
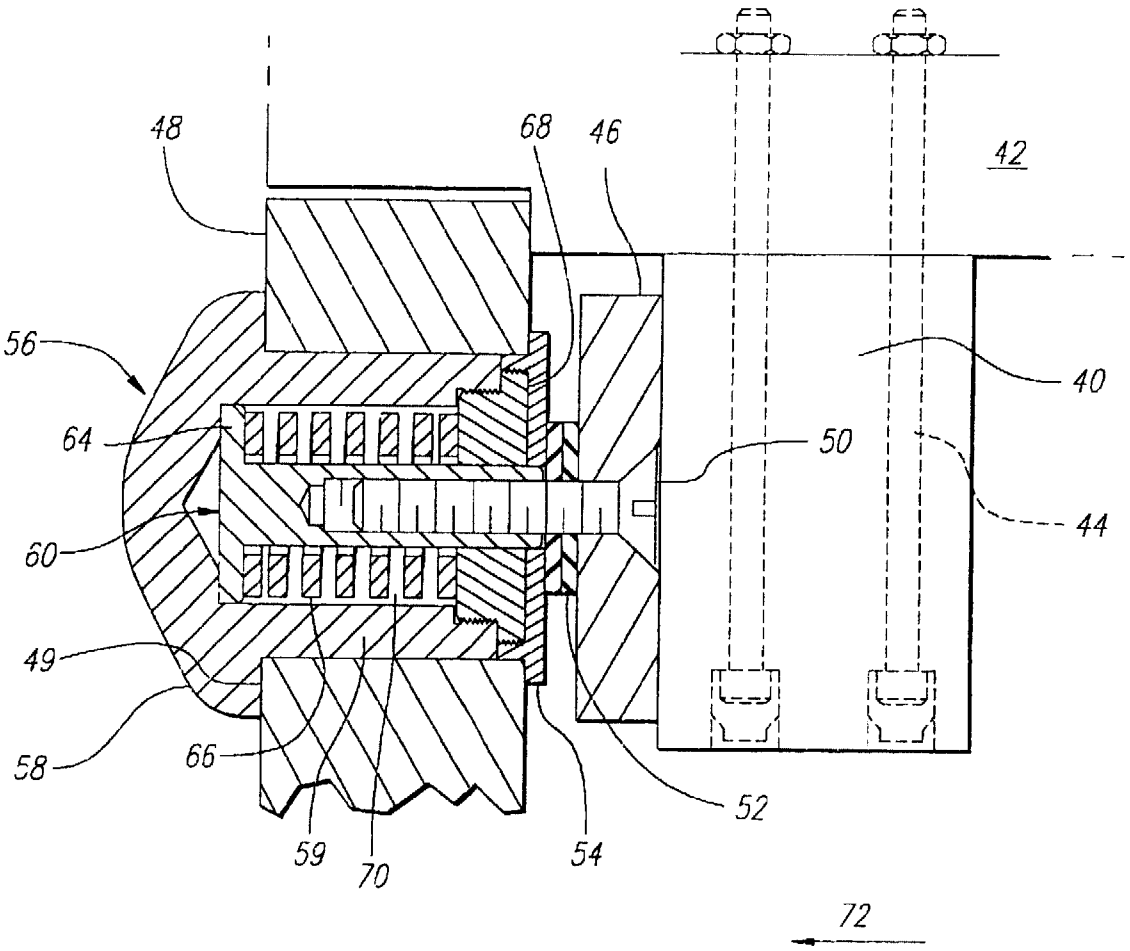
FIG. 3 is a sectional view of an impact resistant door lock according to the present invention, shown in its uncompressed state.
Figure 4:
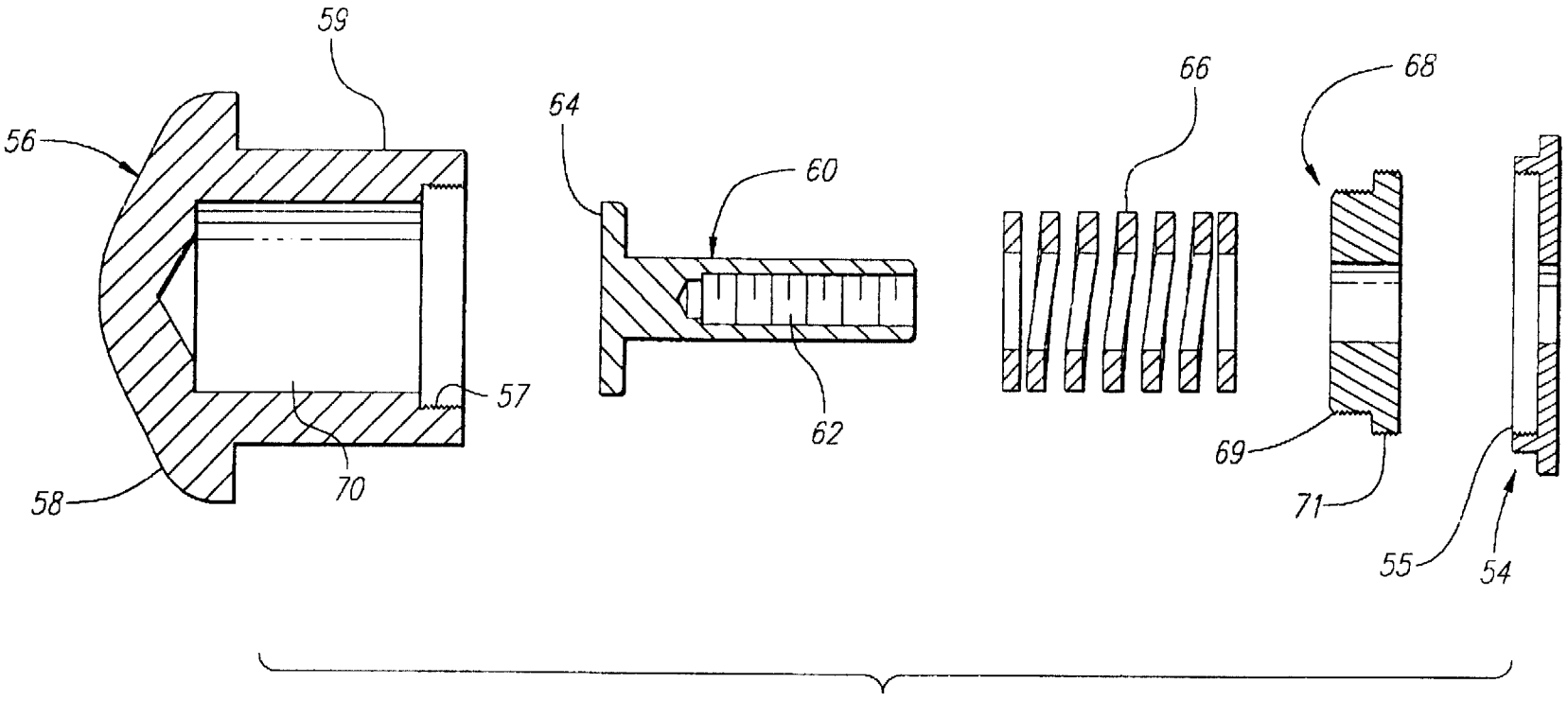
FIG. 4 is an exploded sectional view of the impact resistant internally threaded bolt assembly shown in FIG. 3.

Referring now to FIGS. 3 and 4, a preferred embodiment of the present invention includes an electromagnet 40 mounted onto a door frame 42 via tamper resistant electromagnet mounting bolts 44 or other tamper resistant mounting means. Strike plate 46 is mounted onto door 48 via strike plate mounting bolt 50. One or more flexible washers 52 allow strike plate 46 to swivel so that strike plate 46 can abut electromagnet 40 in full contact for maximum hold force when door 48 is shut and electromagnet 40 is energized.

The improved, force-absorbing internally threaded bolt assembly of the present invention includes a bolt housing 56 having a flange or head 58 which abuts the rear face 49 of door 48, and a shaft 59. Bolt housing 56 is preferably tamper-resistant from its exposed end, although this is not strictly necessary in those applications where tampering from the exposed end is not considered to be a threat.

Inside housing 56 is fitted plunger 60 having spring engagement or flanged portion 64 and having female threads 62 (FIG. 4). Spring 66 is also fitted inside housing 56. Plunger 60 and spring 66 are retained within cavity 70 of housing 56 by seal cap 68. Seal cap 68 is an annular member having inner threads 69 for engaging corresponding threads 57 on housing shaft 59, and having outer threads 71. The foregoing components are held firmly in place within door 48 by post installation cap 54, having female threads 55 that engage corresponding outer threads 71 of seal cap 68. Male threads on strike plate mounting bolt 50 engage female threads 62 within plunger 60 to fasten plunger 60 to strike plate 46. Thus, plunger 60 serves to couple strike plate mounting bolt 50 to spring 66. Spring 66 preferably has a compression force approximately equal to or slightly less than the hold strength of electromagnet 40, when spring 66 is compressed a predetermined maximum allowable travel distance.

Figure 5:
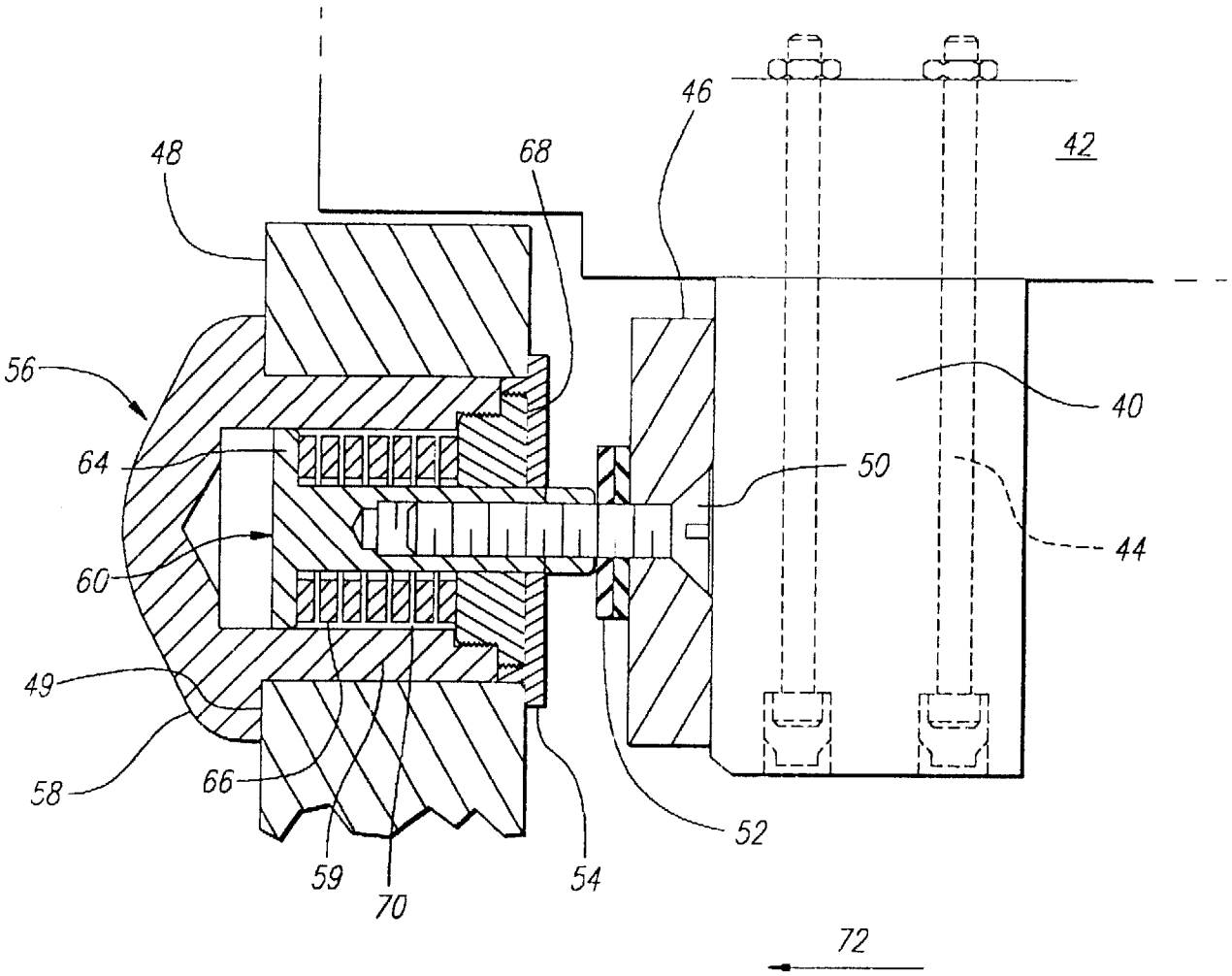
FIG. 5 is a sectional view of the impact resistant door lock of FIG. 3, shown in its compressed state.

FIG. 5 illustrates the mechanism of FIG. 3 when a force is applied in direction 72 to door 48, such that spring 66 is compressed. From FIG. 5, it can be seen that a blow to the door coming from indicated direction 72 will have the effect of allowing a limited amount of linear movement of door 48 and housing 56 relative to electromagnet 40, strike plate 46, and plunger 60. Flanged portion 64 of plunger 60 compresses spring 66 against seal cap 68. Compression of spring 66 absorbs and dissipates much of the force of the blow applied against door 48, greatly increasing the security of the electromagnetic lock against this type of attack. As soon as the force is removed from the door, spring 66 will cause door 48 to spring back to its original, fully closed and locked position.

It is desired that spring 66 have a constant compressive force that is equal to or slightly less than the holding strength of electromagnet 40. With such a spring having constant compressive force, the greatest amount of energy can be absorbed by the door for a given maximum acceptable amount of door travel, and a specified maximum compressive force. Springs normally exhibit compressive forces that increase linearly with compression distance, rather than being constant as desired. One way to cause spring 66 to exhibit a more uniform compressive force over the compression distance of interest is to use a spring with a lower spring modulus, but pre-bias the spring by compressing it. Pre-biasing can be accomplished by tightening strike plate mounting bolt 50, by providing a housing 56 having cavity 70 that is shorter than spring 66 in its completely decompressed state, by providing shim washers between spring 66 and seal cap 68, by additionally tightening seal cap 68, or by many other means that will be apparent to one skilled in the art. If a particular installation requires a relatively short maximum allowable travel distance, a shorter spring may be used in conjunction with shim washers. For many applications, spring 66 will preferably be capable of exerting a full compressive force equal to the power of the lock. It has been found that die springs provide a compressive force and spring constant that is often suitable, in that they provide optimum performance when fully compressed under a shock load.

As a feature of the present invention, many of the same components of the force-absorbing internally threaded bolt assembly may be used regardless of the maximum allowable travel distance and the resilient force at that travel distance required for a particular installation. These parameters may be adjusted over a wide range by simply selecting a spring 66 with the desired length and spring constant to be placed within cavity 70 and selecting the amount of pre-bias to be placed on the spring.

It is not necessary that a spring 66 be used. Spring 66 may be replaced by other resilient means such as an elastomeric material, a gas compression chamber, or other resilient, force-absorbing mechanisms known to those skilled in the art. A resilient mechanism with two or more smaller springs may be also employed instead of the single larger spring. It is noted that with a door that is relatively thin, some of the components of the present invention may lie substantially outside of the space between the two faces of the door, and thus will protrude significantly beyond rear face 49 of door 48 (FIG. 3).

Although the present invention has thus been described in detail with regard to the preferred embodiments and drawings thereof, it should be apparent to those skilled in the art that various adaptations and modifications of the present invention may be accomplished without departing from the spirit and the scope of the invention. Accordingly, it is to be understood that the detailed description and the accompanying drawings as set forth hereinabove are not intended to limit the breadth of the present invention, which should be inferred only from the following claims and their appropriately construed legal equivalents.

What is claimed is:

1. An impact resistant electromagnetic lock assembly comprising:

an electromagnet for mounting on a door frame;

a strike plate for engagement with said electromagnet to provide a predetermined electromagnetic door holding force;

means for mounting said electromagnet on the door frame;

means for mounting said strike plate on a door for locking engagement with said electromagnet to hold said door in a locked and closed position; and resilient means included in said strike plate mounting means, for permitting limited movement of the door relative to said strike plate upon an impact force applied to said door, and prompt restoration of the door to its locked and closed position, said limited movement being confined to a predetermined maximum allowable travel distance, wherein said resilient means is selected to provide sufficient resiliency to prevent a blow which is otherwise sufficient to overcome said electromagnetic door holding force and thus force said door open, from causing said strike plate to separate from said electromagnet; and said electromagnet exerting force on said strike plate in a predetermined direction adequate to prevent opening of said door in a direction opposite to said predetermined direction.

2. An impact resistant electromagnetic lock assembly as defined in claim 1 wherein:

said resilient means has a resilient force approximately equal to said predetermined door holding force of said electromagnet and said strike plate, when said resilient means is deformed by an amount equal to said predetermined maximum allowable travel distance.

3. An impact resistant electromagnetic lock assembly as defined in claim 2 wherein said resilient means is a spring, said spring being deformed by compression.

4. An impact resistant electromagnetic lock assembly as defined in claim 1 wherein said predetermined maximum allowable travel distance is at least one-half of an inch.

5. An impact resistant electromagnetic lock assembly as defined in claim 1 wherein said strike plate mounting means further comprises:

a bolt housing having a flange connected to a hollow shaft, said hollow shaft insertable within a door so that said flange abuts a first face of said door, said resilient means being located within said hollow shaft;

means for retaining said resilient means within said hollow shaft;

a strike plate mounting bolt engaging said strike plate; and a coupling member for coupling said strike plate mounting bolt to said resilient means.

6. An impact resistant electromagnetic lock assembly as defined in claim 5 wherein said retaining means comprises an annular member threadably engageable with said hollow shaft.

7. An impact resistant electromagnetic lock assembly as defined in claim 6 wherein said coupling member comprises a plunger, the plunger comprising:

a flanged portion for engaging said resilient means; and a threaded portion for engaging corresponding threads on said strike plate mounting bolt.

8. An impact resistant electromagnetic lock assembly as defined in claim 7 further comprising:

means for pre-biasing said resilient means.

9. The impact resistant electromagnetic lock assembly as defined in claim 8 further comprising:

a flexible member abutting said strike plate for allowing said strike plate to swivel to engage said electromagnet in coplanar abutment.

10. The impact resistant electromagnetic lock assembly as defined in claim 1 wherein said resilient means has a full compressive force slightly less than said predetermined door holding force of said electromagnet and said strike plate.

11. An impact resistant electromagnetic lock assembly as defined in claim 1, wherein:

said electromagnet exerts an electromagnetic locking force on said strike plate; and said resilient means deforms in said predetermined direction to absorb an externally applied shock force that would be sufficiently severe to overcome said locking force in the absence of said resilient means.

12. An impact resistant electromagnetic lock assembly as defined in claim 1 wherein:

said resilient means is a die spring.

13. An impact resistant electromagnetic lock assembly as defined in claim 1 wherein:

said resilient means is a spring having a spring constant comparable to a die spring.

14. An impact resistant electromagnetic lock assembly comprising:

an electromagnet for mounting on a door frame;

a strike plate magnetically lockable with said electromagnet when said electromagnet is energized;

a shock-absorbing assemblyfor mounting said strike plate to a door; and a fastener for coupling said strike plate to said shock-absorbing assembly;

wherein said shock-absorbing assembly allows a limited amount of linear movement of said door relative to said strike plate; and wherein said shock-absorbing assembly is selected such that said shock-absorbing assembly is capable of absorbing a shock which is otherwise sufficient to overcome an electromagnetic holding force between said electromagnet and said strike plate.

15. An impact resistant electromagnetic lock assembly as defined in claim 14 wherein said shock-absorbing assembly comprises:

a bolt having a head, a shaft having a first end adjacent said head and a second end disposed opposite said head, and a cavity within said shaft, said cavity having an opening at said second shaft end;

a spring disposed within said cavity, said spring having a first end disposed adjacent said first shaft end, said spring having a second end disposed adjacent said second shaft end;

means for retaining said spring within said cavity; and a spring engagement element for engaging said spring;

wherein said fastener for coupling said strike plate to said shock-absorbing assembly is engageable with said spring engagement element.

16. An impact resistant electromagnetic lock assembly as defined in claim 15 wherein:

said spring retaining means is disposed at said second shaft end and adjacent said second spring end; and said spring engagement element includes a spring engagement portion disposed at said first spring end for compressively engaging said spring.

* * * * *